US005487710A

United States Patent [19]

Lavorgna et al.

[11] Patent Number: 5,487,710

[45] Date of Patent: Jan. 30, 1996

[54] SWIMMER'S DRAG SUIT HAVING DETACHABLE AND REPOSITIONABLE POCKETS

[76] Inventors: Blaise Lavorgna, 27735 Pemberton Dr.; Peter R. Sebastian, 27163 Loch Lomond Ct., both of Salisbury, Md. 21801

[21] Appl. No.: 413,266

[22] Filed: Mar. 30, 1995

[51] Int. Cl.[6] ..... A63B 31/00

[52] U.S. Cl. ..... 482/55; 482/111; 2/67; 441/55

[58] Field of Search ..... 482/55, 111; 441/55, 441/59, 60; 2/67

[56] References Cited

U.S. PATENT DOCUMENTS

| | | | |
|---|---|---|---|
| 4,071,236 | 1/1978 | Oprean . | |
| 4,074,904 | 2/1978 | Arcidiacono . | |
| 4,302,007 | 11/1981 | Oprean et al. . | |
| 5,004,227 | 4/1991 | Hoffman | 482/55 |
| 5,033,116 | 7/1991 | Itagaki et al. | 441/55 |

FOREIGN PATENT DOCUMENTS

| | | | |
|---|---|---|---|
| 0992764 | 5/1965 | United Kingdom | 2/67 |

*Primary Examiner*—Lynne A. Reichard
*Attorney, Agent, or Firm*—Wenderoth, Lind & Ponack

[57] ABSTRACT

A device for training swimmers includes a swimsuit, one or more drag-creating strips, and fastener(s) for detachably fastening the drag-creating strip(s) to the swimsuit. Each drag-creating strip includes non-porous material forming at least one pocket having a closed bottom, closed sides and an open top. During swimming, water entering the pocket will impact against the sides and bottom of the pocket, thereby creating turbulence. Such turbulence produces resistance to the movement of the swimmer through the water. The layout and number of fasteners allows the drag-creating strip(s) to be attached to the swimsuit in any one of various orientations. Thus, the pockets can be oriented at optimal positions relative to the movement of the swimmer through the water. Moreover, the pockets can be oriented in a manner that isolates a particular muscle group for training. The number of drag-creating strips which can be fastened to the swimsuit is also variable where in turn the degree of resistance offered by the training device is variable. The drag-creating strips can also be fastened to the swimsuit assymetrically so as to work one side, i.e. a weaker side, of the body to a greater extent than the other side.

17 Claims, 3 Drawing Sheets

SWIMMER' S DRAG SUIT HAVING DETACHABLE AND REPOSITIONABLE POCKETS

BACKGROUND OF THE INVENTION

1. Field of the Invention

The present invention relates to a device for training swimmers, and in particular to a drag suit comprising both a swimsuit and a drag-creating strip fastened to the swimsuit and having at least one cavity into which water flows during swimming to create drag.

2. Background of the Invention

Competitive swimming races are often decided by fractions of a second. The winning edge is usually the result of the training process. A variety of methods, such as dry land exercise programs, as well as various devices offering resistance during swimming, have been used in an attempt to enhance the swimmer's power and endurance. However, several of these methods and devices interfere with the swimmer's technique and natural stroke mechanics. Of these devices, a swimmer's drag suit is least likely to interfere with the technique and natural stroke mechanics of the swimmer.

The purpose of such drag suit is to provide resistance to the movement of the swimmer through the water. The drag suit accomplishes this function by the provision of various elements attached to a swimsuit and which elements impede the flow of water over the swimsuit.

For instance, U.S. Pat. Nos. 4,302,007 and 4,074,904 disclose belts which can be worn over the swimmer's swimsuit. In U.S. Pat. No. 4,302,007, a plurality of perforated pockets are sewn to the belt. Thus, when the belt is worn during swimming, water entering the pockets passes through the perforated material thereof, whereby the perforations impede the flow of water and create resistance to the movement of the swimmer through the water. On the other hand, in U.S. Pat. No. 4,074,904, a plurality of vanes in the form of tapered channels are integrated with the belting material. Thus, when the belt is worn during swimming, water is funneled through the tapered vanes, whereby again the flow of water is impeded thereby creating resistance to the movement of the swimmer through the water.

U.S. Pat. No. 4,071,236 discloses a device in which perforated pockets are sewn directly onto the swimsuit of the swimmer. The mechanism for creating resistance to the movement of the swimmer through the water is the same as that employed in U.S. Pat. No. 4,302,007.

Although, as mentioned above, all of these prior art devices provide resistance to the movement of the swimmer through the water in a manner least likely to interfere with the technique and natural stroke mechanics of the swimmer, these prior art devices nonetheless have several drawbacks.

First, these devices are only general in effect. Specifically, these devices cannot be used to train any particular area of weakness of the swimmer and cannot isolate any particular muscle group for training.

Another drawback is that these devices do not use the flow of water over the body of the swimmer to its maximum extent in creating resistance to the movement of the swimmer through the water.

SUMMARY OF THE INVENTION

It is a first object of the present invention to provide a device for training swimmers which is versatile in that the same device can be used in training in connection with different swimming strokes and/or which can be used to train a particular muscle group during the execution of any such stroke.

To achieve this object, the present invention provides a device for training swimmers comprising a swimsuit, a drag-creating strip forming at least one cavity which is to receive water during swimming, and a fastener which allows the drag-creating strip to be detachably fastened to the swimsuit in any one of a plurality of different orientations. Thus, the open end of the cavity into which water will flow during swimming is positionable on the swimsuit at various orientations relative to the direction of movement of the swimmer through the water. In this way, the drag-creating strip can be oriented on the swimsuit in a position most effective for the particular type of stroke being executed by the swimmer and/or in a position most suitable for training a particular muscle group used during the execution of such stroke by the swimmer.

Another object of the present invention is to provide a device for training swimmers which is versatile in that it can be used to enhance the power and endurance of one side of the swimmer, i.e. a weaker side of the swimmer.

To this end, the present invention provides a device for training swimmers comprising a swimsuit, at least two drag-creating strips each forming at least one cavity which is to receive water during swimming, and fasteners that detachably fasten the drag-creating strips at symmetrical positions on the swimsuit. When both of the drag-creating strips are detachably fastened on the swimsuit, both sides of the body of the swimmer will be worked by the device to generally equal extents during swimming. However, when only one of the two drag-creating strips is detachably fastened at its respective position on the swimsuit, one side of the body will be worked to a greater extent than the other side of the body during swimming.

Another object of the present invention is to provide a device for training swimmers which is highly efficient in creating drag during movement of the swimmer through the body of the water.

To achieve this object, the present invention provides a device for training swimmers comprising a swimsuit, and a drag-creating strip fastened to the swimsuit, the drag-creating strip comprising non-porous material forming at least one pocket having a closed bottom, closed sides, and an open top. The drag-creating strip thus forms at least one cavity into which water can flow only through the top of the pocket and from which water can flow also only through the top of the pocket. Thus, during swimming, water entering the cavity will impact against the sides and bottom of the pocket, thereby being trapped in the pocket and creating turbulence. The impact of the water against the sides and bottom of the pocket and the resulting turbulence produce maximum resistance to the movement of the swimmer through the water.

BRIEF DESCRIPTION OF THE DRAWINGS

These and other objects, features and advantages of the present invention will become more apparent to those of ordinary skill in the art upon reviewing a detailed description of the invention made below with reference to the accompanying drawings, in which.

DETAILED DESCRIPTION OF THE PREFERRED EMBODIMENT

The device for training swimmers according to the present invention generally comprises three components, namely a swimsuit, one or more drag-creating strips, and fastener(s) for fastening the drag-creating strip(s) to the swimsuit.

Figure 1:
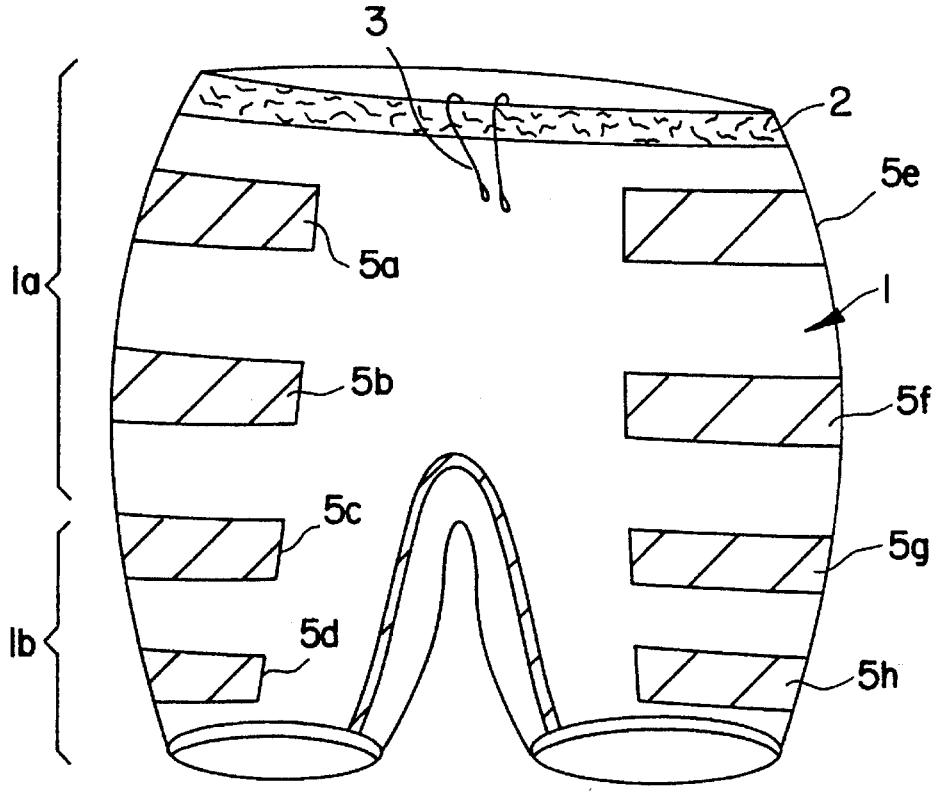
FIG. 1 is a front view of a swimsuit of a device for training swimmers according to the present invention.
Figure 2:
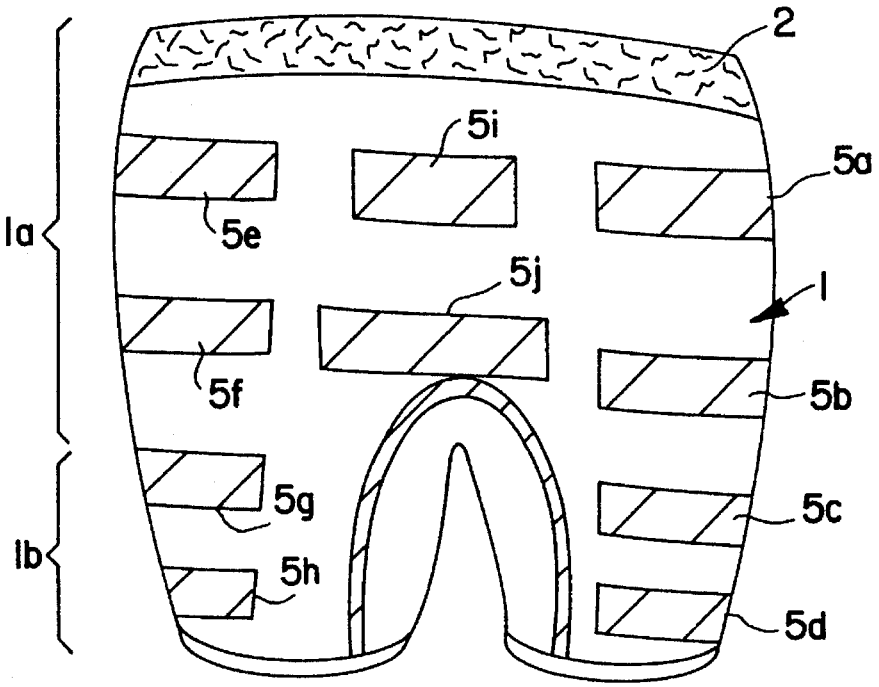
FIG. 2 is a rear view of the swimsuit.
Figure 3:
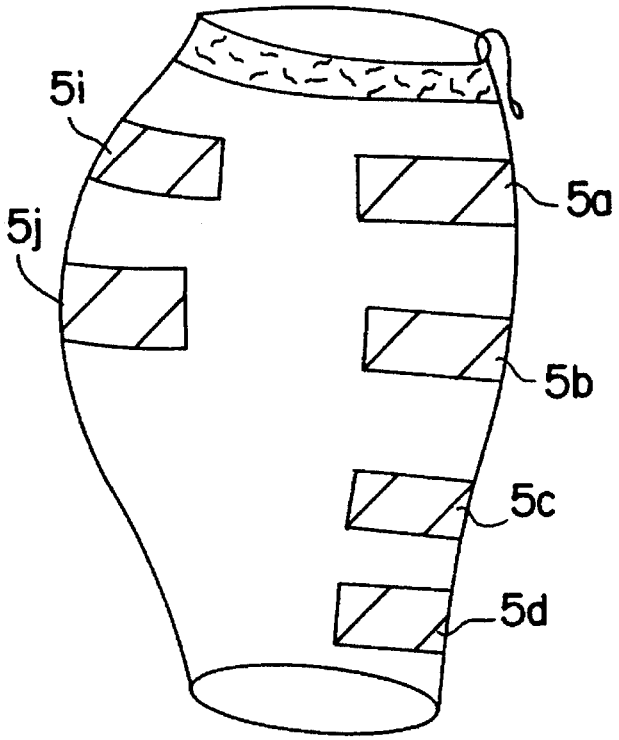
FIG. 3 is a side view of the swimsuit.

FIGS. 1–3 show the swimsuit without the drag-creating strip(s) fastened thereto. The swimsuit 1 is made from an elastic textile material generally referred to as spandex. However, various other textile materials which do not absorb substantial amounts of water could be used. Therefore, the swimsuit will not produce an undesirable effect of adding water weight which would pull the swimmer's lower body down into the water. The swimsuit 1 generally includes a waist portion 1*a* ending in an elastic waistband 2 in which a drawstring 3 is accommodated in a per se known manner, and tubular leg portions 1*b* to be worn around upper parts of the legs of the swimmer.

Figure 4:
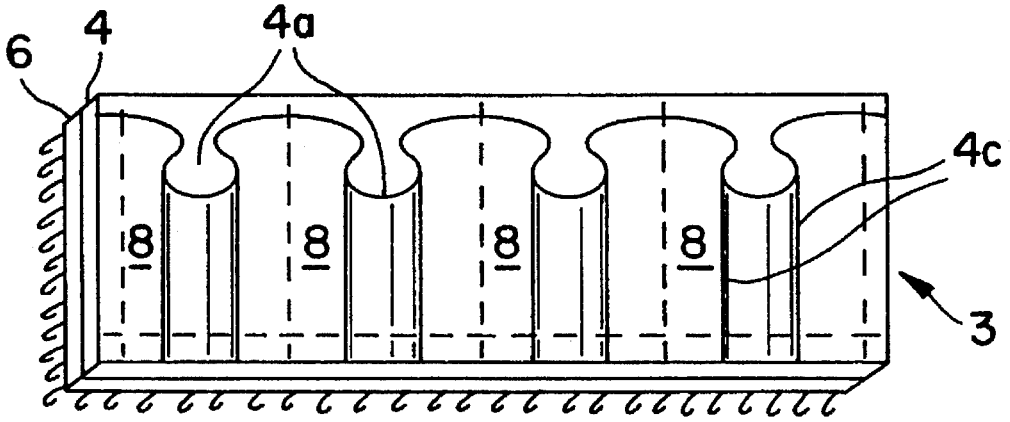
FIG. 4 is a perspective view of a drag-creating strip that is fastenable to the swimsuit of the device for training swimmers.

FIG. 4 shows a drag-creating strip 3 comprising non-porous material 4, such as nylon, forming at least one cavity 4*a* having an open end (at the top of FIG. 4).

The fastener(s) for detachably fastening the drag-creating strip 3 to the swimsuit 1 comprises hook and loop fastener(s) of the type manufactured by VELCRO. These hook and loop fastener(s) are in the form of a plurality of patches 5*a*–5*j* of the loop-type fastener integral with (e.g. sewn to) the swimsuit 1 and a patch 6 of hook-type fastener integral with the drag-creating strip 3. Needless to say, the hook-type fasteners could be integrated with the swimsuit 1 with the loop-type fastener being integral with the drag-creating strips 3.

Referring again to FIG. 4, the material 4 of the drag-creating strip is folded along a series of lines 4*c* on a patch 6 of the loop-type fastener and is sewn onto the patch along the chain lines shown in the figure which indicate sewn seams. Thus, the material 4 of the drag-creating strip 3 forms pocket(s) 8 having a bottom closed by the lower horizontally extending seam shown in the figure, sides closed by the vertically extending seams shown in the figure and an open top. The cavities 4*a* is defined by the pockets 8 taper from the open top to the closed bottom thereof as is evident from the figure.

The possible uses of the device for training swimmers according to the present invention will now be described.

The layout of the patches 5*a*–5*j* of the loop-type fastener on the swimsuit as illustrated in FIGS. 1–3 allow one or more drag-creating strips 3 to be detachably fastened to the swimsuit in any one of a plurality of different orientations. Thus, the open end of the cavity or cavities 4*a* of each drag-creating strip 3 is positionable on the swimsuit worn by the swimmer at various orientations relative to the direction of movement of the swimmer through the water.

Figure 5:
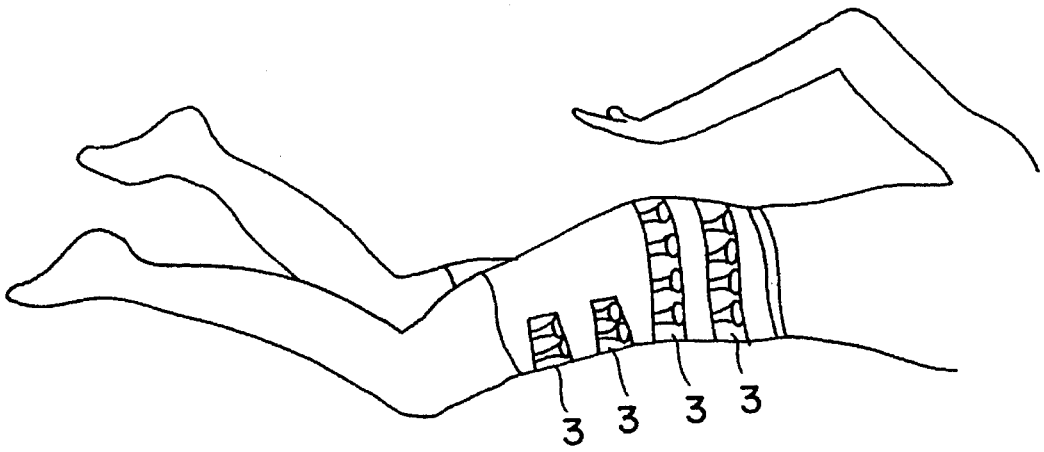
FIG. 5 is a schematic diagram of a swimmer wearing the training device according to the present invention, with the drag-creating strips oriented in a first position at which the strips will offer resistance to forward movement of the swimmer through the body of the water.
Figure 6:
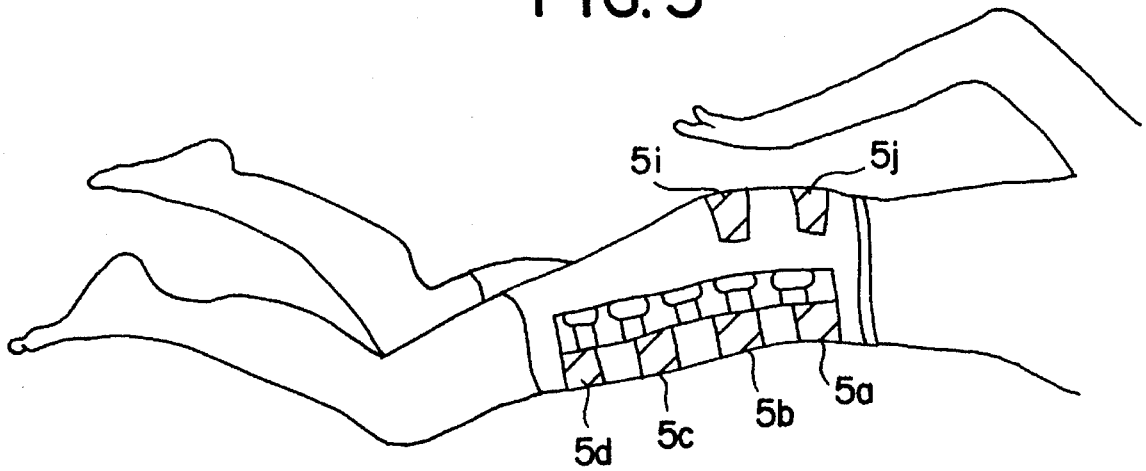
FIG. 6 is a similar view but showing a drag-creating strip in a second position at which the strip will create resistance to upward movement of the upper portion of the leg.
Figure 7:
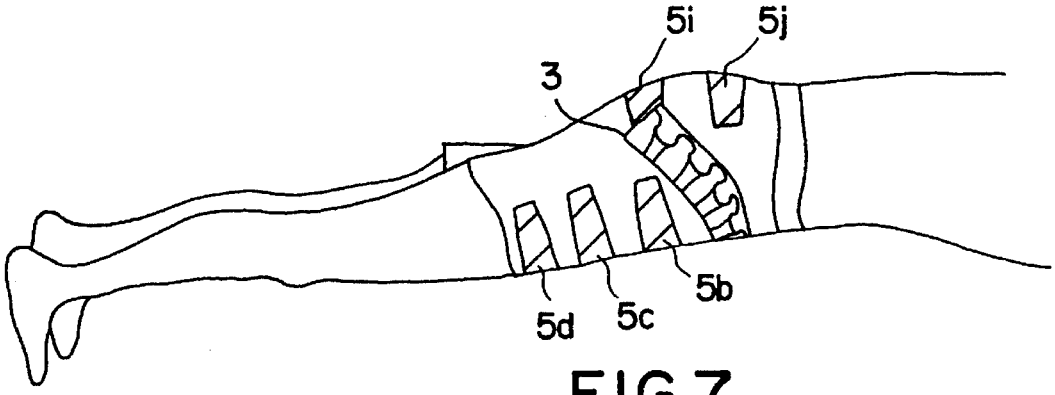
FIG. 7 is another similar view showing the drag-creating strip fastened to the swimsuit in a different orientation useful for training a swimmer executing the breast stroke or butterfly stroke.

For instance, if the swimmer is executing the crawl, one or more of the drag-creating strips 3 should be fastened to the swimsuit 1 in an orientation in which the open ends of the cavities 4*a* face the forward direction, i.e. to the right as shown in FIG. 5. In this way, as the swimmer moves through the water, the water enters the cavities 4*a* through the open ends thereof and becomes trapped in the pockets 8, thereby creating turbulence and offering resistance to the forward movement of the swimmer through the water.

The number and alignment of the drag-creating strips 3 that are actually attached to the swimsuit can be varied according to the needs of the swimmer. For example, in the early phases of training, it may be desirable to use only a small number of pockets 8. In this case, perhaps only one drag-creating strip 3 is attached to the swimsuit. For instance, one relatively short drag-creating strip 3 can be attached to the patch 5*i*. As the training progresses, a longer drag-creating strip thus having a greater number of cavities 4*a* can be attached to the patches 5*a*, 5*e* and 5*i*. As can be seen best in FIG. 2, these patches 5*a*, 5*e* and 5*i* are aligned in generally the circumferential direction of the swimsuit, whereby drag-creating strips of various lengths, i.e. a length corresponding to only that of the patch 5*i* or a length spanning the patch 5*a* as well as the gap between patch 5*i* and patches 5*a*, 5*e*, can be detachably fastened to the swimsuit. Similarly, patches 5*b*, 5*f* and 5*j* are aligned in generally the circumferential direction of the swimsuit. Eventually, for maximum training, the swimmer can attach a long drag-creating strip 3 to aligned patches 5*a*, 5*e* and 5*i*, another long drag-creating strip 3 to aligned patches 5*b*, 5*f* and 5*j*, and four comparatively short drag-creating strips 3 to patches 5*c*, 5*d*, 5*g* and 5*h*, respectively, as shown in FIG. 5.

Another advantage of the present invention resides in the fact that the patches 5*a*–5*d* and the patches 5*e*–5*h* are disposed at positions on the swimsuit that are symmetrical with respect to a longitudinal center line of the swimsuit, i.e. a line located between the right and left sides of the body of a swimmer wearing the swimsuit. To be more specific, the patches 5*a* and 5*e* are located at respective positions on the swimsuit symmetrical with respect to the longitudinal center line of the swimsuit, the patches 5*b*, 5*f* are located at respective positions on the swimsuit symmetrical with respect to the longitudinal center line of the swimsuit, etc.

Thus, when drag-creating strips are detachably fastened at the same orientation on patches 5*c*, 5*g*, for example, the drag-creating strips are disposed symmetrically on the swimsuit such that both sides of the body of the swimmer will be worked by the device to generally equal extents during swimming. However, if only one drag-creating strip 3 were detachably fastened on the swimsuit to patch 5*c*, one side of the body of the swimmer would be worked by the device to a greater extent than the other side of the body during swimming. A similar effect would be produced by attaching more drag-creating strips on the left-hand side of the swimsuit, i.e. to patches 5*e*–5*h*, than on the right-hand side of the suit. Such a set-up of the device is useful in training a swimmer having a weak side.

To take maximum advantage of the flow of water relative to the body as a means for generating resistance, the drag-creating strip(s) 3 comprises a non-porous material that forms pockets 8 having a closed bottom, closed sides and an open top. The water can thus only flow in and out of the pockets 8 through the tops thereof. Accordingly, when the device is being used, water entering the cavities 4*a* during swimming will be trapped in the pockets 8, thereby creating turbulence and opening the pockets 8 to a maximum extent assuming that the drag-creating strip 3 is disposed at a correct orientation relative to the movement, i.e. with the open top of the pocket facing the direction of movement. The turbulence of the water trapped in the pockets 8, and the actual trapping of the water within the pockets 8 which opens the pockets to maximize the area of the open top ends thereof, produces a high degree of resistance per unit size of the drag-creating strip 3. The present invention is thus very efficient in training swimmers.

Although the present invention has been described in connection with a preferred embodiment thereof, it will be apparent that various changes and modifications may be imparted thereto without departing from the true spirit of the present invention. For instance, although the swimsuit has been shown and described with respect to a pair of swimming trunks of a style worn by men, the swimsuit could take the form of a one-piece swimming suit typically worn by women. On the other hand, it should be noted that even the swimsuit shown in the figures may be slipped over the conventional swimsuits worn by competitive men or women swimmers. Moreover, although the drag-creating strip 3 shown in FIG. 4 has only four pockets 8, the present invention is not limited to such drag-creating strips 3. The drag-creating strips 3 will be separate accessories having various numbers of pockets 8 and lengths, whereby the individual swimmer can choose the size and number of drag-creating strips 3 appropriate for the training exercise. Similarly, the layout and number of patches 5*a*–5*h* which are integrated with the swimsuit 1 may be different than that shown in the figures. For versatility, the layout and number of patches should, however, allow for variations in the orientations in which the drag-creating strip(s) 3 can be attached to the swimsuit, and should allow for both a symmetrical and asymmetrical disposition of the drag-creating strip(s) 3 on the swimsuit. Still further, although the fasteners have been described as being of the VELCRO type, other fasteners such as snaps, which allow the drag-creating strip(s) 3 to lie relatively flat on the swimsuit 1 could be used. In this case, the snaps would be arrayed in a pattern corresponding to the patches 5*a*–5*i* and 6.

All such changes and modifications are seen to be within the true scope of the present invention as defined by the appended claims.

What is claimed is:

1. A device for training swimmers, said device comprising: a swimsuit; a drag-creating strip comprising material forming at least one cavity having an open end; and fastening means for detachably fastening the drag-creating strip to said swimsuit in any one of a plurality of different orientations, whereby the open end of said at least one cavity is positionable on the swimsuit worn by the swimmer at various orientations relative to the direction of movement of the swimmer through the water.

2. A device as claimed in claim 1, wherein said fastening means comprises a hook and loop fastener in the form of a plurality of patches integral with said swimsuit and the material of said drag-creating strip, respectively.

3. A device as claimed in claim 2, wherein said swimsuit includes a waist portion to be worn around the waist of the swimmer and tubular leg portions to be worn around upper parts of the legs of the swimmer, wherein said patches include at least two patches each integral with one of the tubular leg portions of the swimsuit and extending longitudinally in a generally circumferential direction of said one of the tubular leg portions, and another patch integral with said drag-creating strip, said at least two patches spaced from one another in an axial direction of said one of the tubular leg portions, and said another patch having a length at least equal to the distance that said at least two patches are spaced from one another in said axial direction, whereby said another patch can be detachably fastened to either of said at least two patches in a first position at which the drag-creating strip extends in the circumferential direction of said one of the tubular leg portions of said swimsuit and can be detachably fastened to both of said at least two patches in a second position at which the drag-creating strip extends in the axial direction of said at least one of the tubular leg portions of said swimsuit.

4. A device for training swimmers, said device comprising: a swimsuit; at least two drag-creating strips each comprising material forming at least one cavity having an open end; and fastening means for detachably fastening said at least two drag-creating strips at respective positions on the swimsuit symmetrical with respect to a longitudinal centerline of the swimsuit which centerline will be located between right and left sides of the body of a swimmer wearing the swimsuit, whereby when both of said drag-creating strips are detachably fastened at said respective positions on the swimsuit both sides of the body of the swimmer will be worked by the device to generally equal extents during swimming whereas when only one of the two drag-creating strips is detachably fastened at its respective position on the swimsuit one side of the body of the swimmer will be worked by the device to a greater extent than the other side of the body during swimming.

5. A device as claimed in claim 4, wherein said fastening means comprises a hook and loop fastener in the form of patches integral with said swimsuit at said symmetrical positions, respectively, and patches integral with the material of said drag-creating strips, respectively.

6. A device for training swimmers, said device comprising: a swimsuit; and at least one drag-creating strip fastened to said swimsuit, said drag-creating strip comprising non-porous material forming at least one pocket having a closed bottom, closed sides, and an open top to thereby define a cavity into which and from which water can flow only through the top of the pocket, whereby water entering the cavity during swimming will be trapped in the pocket thereby creating turbulence offering resistance to movement of the swimmer through the water.

7. A device as claimed in claim 6, wherein said drag-creating strip forms a series of said pockets.

8. A device as claimed in claim 6, wherein said at least one drag-creating strip comprises a plurality of drag-creating strips fastened to said swimsuit.

9. A device as claimed in claim 8, wherein each of said strips forms a series of said pockets.

10. A device as claimed in claim 6, and further comprising fastening means for detachably fastening said at least one drag-creating strip to said swimsuit.

11. A device as claimed in claim 10, wherein said fastening means comprises a hook and loop fastener in the form of a plurality of patches integral with said swimsuit and the material of said drag-creating strip, respectively.

12. A device as claimed in claim 7, and further comprising fastening means for detachably fastening said at least one drag-creating strip to said swimsuit.

13. A device as claimed in claim 12, wherein said fastening means comprises a hook and loop fastener in the form of a plurality of patches integral with said swimsuit and the material of said drag-creating strip, respectively.

14. A device as claimed in claim 8, and further comprising fastening means for detachably fastening said plurality of drag-creating strip to said swimsuit.

15. A device as claimed in claim 14, wherein said fastening means comprises hook and loop fasteners in the form of a plurality of patches integral with said swimsuit and the material of said drag-creating strips, respectively.

16. A device as claimed in claim 9, and further comprising fastening means for detachably fastening said plurality of drag-creating strips to said swimsuit.

17. A device as claimed in claim 16, wherein said fastening means comprises hook and loop fasteners in the form of a plurality of patches integral with said swimsuit and the material of said drag-creating strips, respectively.

* * * * *